US005379489A

United States Patent [19]

Delk et al.

[11] Patent Number: 5,379,489

[45] Date of Patent: Jan. 10, 1995

[54] BAG CLOSURE CLAMP WITH HINGE-SUPPLEMENTING COMPLEMENTARY CAM SURFACES

[75] Inventors: Robert E. Delk, Dallas; Michael L. Bowen, Arlington, both of Tex.

[73] Assignee: Struckmeyer Corporation, Dallas, Tex.

[21] Appl. No.: 45,258

[22] Filed: Apr. 13, 1993

[51] Int. Cl.[6] ..... B65D 77/10

[52] U.S. Cl. ..... 24/30.5 R; 24/543

[58] Field of Search ..... 24/30.5 R, 30.5 P, 543

[56] References Cited

U.S. PATENT DOCUMENTS

| | | | |
|---|---|---|---|
| D. 276,596 | 12/1984 | Kisha | 24/30.5 P |
| 3,036,506 | 5/1962 | Anderson, Jr. et al. . | |
| 3,171,184 | 3/1965 | Posse . | |
| 3,247,852 | 4/1966 | Schneider . | |
| 3,523,534 | 8/1970 | Nolan . | |
| 3,735,765 | 5/1973 | Ichelson . | |
| 3,818,553 | 6/1974 | Parmenter . | |
| 3,874,042 | 4/1975 | Eddleman et al. . | |
| 3,978,555 | 9/1976 | Weisenthal . | |
| 4,212,303 | 7/1980 | Nolan . | |
| 4,296,529 | 10/1981 | Brown | 24/30.5 P |
| 4,523,353 | 6/1985 | Hubbard et al. | 24/30.5 R |
| 4,589,171 | 5/1986 | McGill | 24/543 |
| 4,656,697 | 4/1987 | Näslund | 24/543 |
| 4,887,335 | 12/1989 | Folkmar | 24/30.5 R |
| 5,050,272 | 9/1991 | Robinson, Sr. et al. | 24/30.5 R |
| 5,125,133 | 6/1992 | Morrison | 24/30.5 P |

FOREIGN PATENT DOCUMENTS 49475 3/1889 Germany .

*Primary Examiner*—Richard A. Bertsch
*Assistant Examiner*—Roland G. McAndrews, Jr.
*Attorney, Agent, or Firm*—Richard C. Litman

[57] ABSTRACT

A bag closure for sealing bags. The closure comprises a sheath having a trough which matingly engages a blade-like body of a wedge-shaped member. A roof portion of the sheath is dimensioned so as to be permitted to carry intelligible indicia thereon. An upper edge of the blade-like body is provided with a designated location for receiving a bag. The blade-like body slightly smaller in width than the trough, enabling the closure to clamp the bag tightly therein. A hinge strap which pivotally connects the sheath and the wedge-shaped member is dimensioned to be durable and to ensure that the blade-like body remains in proper alignment with the trough. A latch retains the closure in a closed position. In the closed position, a tip of the latch forms a protuberance is easily displaced to enable the closure to be easily opened. A safety lock ensures that the blade-like body properly aligns with the trough, relieves the stress from the hinge strap, and ensures that the closure does not inadvertently open upon breakage of the hinge strap. With the closure closed, the safety lock is concealed within the trough where it remains unobtrusive. In use, the neck of a bag is folded about the designated location of the blade-like body and, upon closing the closure, the neck of the bag becomes tightly clamped within the trough, sealing the bag against leakage.

6 Claims, 4 Drawing Sheets

BAG CLOSURE CLAMP WITH HINGE-SUPPLEMENTING COMPLEMENTARY CAM SURFACES

BACKGROUND OF THE INVENTION

1. FIELD OF THE INVENTION

The present invention relates generally to ice packs and more particularly, to fasteners or closures for ice packs. The present invention is directed to a hinged, knife-and-sheath type bag closure.

2. DESCRIPTION OF THE PRIOR ART

It is a standard therapeutic procedure to treat specific injuries, such as sprained or strained muscle tissues, by chilling the localized region of the injury to reduce swelling and deter subsequent harm. Ice packs of diverse forms are available for administering to localized injuries. Closures for sealing ice packs are generally of the blade and sheath type. In use, a neck portion of the ice pack is compressed into the sheath by the blade sealing ice in a reservoir or pouch. A flexible hinge secures the blade and sheath together. A locking member, located opposite the hinged end of the clamp, is biased to engage a locking shoulder to maintain the closure in a closed condition. Clamps fitting this general description are well known in the prior art of record. For example, U.S. Pat. No. 3,036,506, issued May 29, 1962 to John H. Anderson, Jr., discloses a clamp having a lock-bar pivotally connected to a channel by a pivot shaft. The pivot shaft passes through apertures in respective ends of the lock-bar and the channel. In a closed position, the channel receives the lock-bar. A wire bail pivotally mounted in apertures in the channel swings over the bar to engage in a notch in the bar to hold the bar firmly in the closed position. The clamp is intended to seal a camera case for use in underwater photography. Unlike Anderson, Jr., applicants' instant invention includes a tapered latch element having a shoulder integral with a first component and engageable with a lip at the end of a second component. Further, Anderson, Jr. does not teach a living hinge with a safety lock feature which reduces the risk of the clamp inadvertently unlatching in the event that the hinge breaks and the two components separate.

Another clamp is disclosed in U.S. Pat. No. 3,171,184, issued Mar. 2, 1965 to Nils L. W. Posse. The clamp includes two members, each being of an elongated shape. The first member comprises opposite end portions substantially parallel relative to one another and spaced apart by an intermediate portion. The end portions extend substantially perpendicularly from the longitudinal axis of the first member, each in the same direction, and flex toward and away from one another. The faces of the end portions facing one another are provided with teeth. The first and second members are formed to cooperate with each other. The second member also includes two end portions and an intermediate portion. The end portions of the second member are constituted by inclined surfaces which terminate within detents. The operation of the clamp is as follows. A tube is placed between the first and second members. The members are moved toward each other and, during this movement, due to the configuration of the two members, the detents and the teeth of the respective end portions engage, pinching the tube between the intermediate portions, and sealing the passage within the tube. The tube is released by applying pressure against the end portions of the first member to disengage the teeth from the detents. The two members are shown pivoted or hinged together at one end. This is accomplished by a pivot pin that passes through walls of both members at one end. Alternatively, the two members are hinged together by a hook-and-pintle arrangement wherein the first member has a hook-like extension and the second member has wall extensions which support a pintle that engages the hook-like extension of the first member. Applicants' instant invention described hereinafter does not include either a pivot pin or a hook-and-pintle arrangement but includes a hinge strap for joining a first and second component together and a safety lock feature to inhibit the accidental separation of these two components. Further, applicants' instant invention includes a single latch element wherein Posse includes two cooperating latch elements.

U.S. Pat. No. 3,247,852, issued Apr. 26, 1966 to John D. Schneider, discloses another clamp. This clamp is in the form of a V-shaped member made of resilient, flexible material. The V-shaped member is provided with a pair of diverging arms secured together at the apex thereof by an integral loop hinge. Locking means is provided at the free end of one of the arms. The locking means is in the form of a catch having a stem portion and a hook portion, engageable with a complementary locking portion of the other of the two arms. The locking portion has a recess and an overlying lip engageable with the hook. Enlarged finger portions are provided which may be grasped between the thumb and forefinger to effect a closure. The diverging arms are provided with teeth to more firmly grip an article between the diverging arms. Schneider does not disclose a safety lock feature associated with the hinge nor does Schneider show a trough and blade, as taught by applicants.

U.S. Pat. No. 3,523,534, issued Aug. 11, 1970 to John L. Nolan, discloses a closure comprising a seat member and a wedge member movably related to one another. The seating surface and the wedge surface are intended to cooperatively capture a pouch therebetween. Each of the members include mutually engageable latch elements for holding the same in a clamped position. The seat member includes a U-shaped trough having two ends and closely spaced apart side walls. One end of the trough carries a pin or pintle element and the opposite end has a latch element or an abutment. The wedge member includes a blade-like body which is slightly narrower in cross-section than the width of trough. One end of the blade-like body has a hinge portion for receiving the pin or pintle and the other end is provided with a latch finger including a cam surface and shoulder to generally abut the latch element. In operation, a bag is folded over the blade-like body which, in turn, is received by the trough where the wedge and the seat are latched closed, thus sealing the bag therebetween. Applicants' instant invention is distinct from that taught by Nolan in that it includes a hinge strap and a safety lock feature.

Yet another clamp is shown in U.S. Pat. No. 3,735,765, issued May 29, 1973 to David L. Ichelson. The clamp comprises first and second jaws being substantially integral and being joined at one end by an integral plastic hinge. A longitudinal slot is formed in the free end of one jaw and a tang is formed integrally with the free end of the other jaw. The tang is received by the slot to lock the jaw in a closed condition. To enhance the retention ability of the clamp, frictional material is applied to the inner surface of each of the two jaws. In use, the jaws are spread apart to receive a thing to be clamped therein and then pressed together until the tang engages the slot in locks the jaws and place. Applicants' disclose a cooperatively engageable latch element and lip which is unlike the tang and slot taught by Ichelson. Furthermore, Ichelson does not disclose a safety hinge feature or a trough for receiving a blade.

A bag closure is disclosed in U.S. Pat. No. 3,818,553, issued Jun. 25, 1974 to Richard L. Parmenter, wherein the bag closure includes a flat base having a living hinge at its center to divide the base into a right leg and a left leg. The width of the living hinge is equivalent to that of the right and left legs. An upwardly and outwardly extending right hook is formed integrally with the outer extreme top surface of the right leg and is engageable with an upwardly and inwardly extending left hook formed integrally with the outer extreme top surface of the left leg. In using the closure clip, the open end or neck portion of a bag or the like is gathered or pinched together and the clip is snapped thereabout by folding one leg relative to the other about the hinge. Alternatively, laterally spaced apart, longitudinally extending corrugations or ribs are formed integrally with the top surface of the legs to enhance the retention of the bag relative to the clip. Unlike the two cooperatively engaging hooks disclosed by Parmenter, applicants' instant invention includes a latch element forming a single hook engageable with a lip. In addition, applicants' invention includes a trough for receiving a blade, which is not disclosed by Parmenter.

A clamp having a lower half which is connected through a hinge to an upper half is disclosed in U.S. Pat. No. 3,874,042, issued Apr. 1, 1975 to Roy T. Eddleman et al. The upper half includes a series of longitudinal ribs and the lower half includes a series of corresponding valleys or grooves for receiving the longitudinal ribs. The closure is held in a closed position through the cooperative engagement of a notch in a lug formed integrally with the upper half and a tongue formed integrally with the bottom half. The width of the hinge is substantially the same as the width of both the top and bottom halves. However, the hinge disclosed by Eddleman et al. does not include a safety lock feature, as does applicants' instant invention. Further, Eddleman et al. does not disclose a latch element in the form of a stem or hook engageable with a lip of a slot. Eddleman et al. also fails to disclose a trough for receiving a blade.

A closure member having a linear leg and an arcuate shaped leg interconnected at one end by a flexible hinge is disclosed in U.S. Pat. No. 3,978,555, issued Sep. 7, 1976 to Marvin L. Weisenthal. A plurality of equidistantly spaced apart, projections extend substantially along the entire length of the interior surface of each leg forming channels therebetween. The projections of one leg fit within the channels the other leg upon locking the closure or clamp. A snap lock includes a leg having a chamfered shoulder engageable with a cut-out section. The leg is disposed at a free end of one of the legs and the cut-out section is disposed at the free end of the other leg. Weisenthal does not disclose a hinge having a safety lock feature. Further, Weisenthal does not show a trough for receiving a blade.

U.S. Pat. No. 4,212,303, issued Jul. 15, 1980 to John L. Nolan, discloses a clamp having arms joined at one of their ends by an integral enlarged loop hinge, formed of a single piece of flexible, resilient material, which may be autoclaved. Opposing surfaces of the arms are provided with teeth to provide for a secure grip of an article to be clamped therebetween. The outer surfaces of the free ends of the arms are provided with transverse ribs for gripping and manipulating the clamp while in use. Locking means are provided including a tongue integral with the free end of the upper arm and a forwardly-facing recess in the free end of the lower arm. The tip of the tongue cammingly engages a ramp in the recess. When the clamp is fully closed, the tongue snaps rearward and lateral notches in the tongue receive projections in the recess. Nolan does not teach a blade engageable with a trough nor a hinge including a safety lock feature.

U.S. Pat. No. 4,294,582, issued Oct. 13, 1981 to Jan I. Naslund, discloses a clip having a male leg, a female leg, and a hinge connecting the two legs together at one end. Located at the end of the clip opposite the hinge is a snap-fit interlocking mechanism comprised of a stud connected to the end of one leg and a catch connected to the end of the other leg. At the distal end of the stud is a detent member having an inclined forward surface. The catch has a collar and a central orifice for receiving the detent. Projecting from the inner face of the male leg is a rib. A mating slot is provided in the inner face of the female leg for receiving the rib. In use, the clip is open to receive an item to be clamped between the two legs and is then closed and locked in the closed position by engaging the stud and the catch. Applicants' instant invention is distinct from Naslund in that applicants include a hinge safety lock feature.

U.S. Pat. Nos. 4,347,848, issued Sep. 7, 1982, and 4,523,353, issued Jun. 18, 1985, both to Vance M. Hubbard et al., disclose a closure member comprising an elongated blade-like member hingedly connected to an elongated sheath member by a flexible element. The blade-like member is a substantially planar member having inwardly inclined front and rear surfaces and a cut in the end thereof proximate the front inclined surface to provide a locking structure for engaging a latching structure on the sheath member. The sheath member has substantially planar side walls connected by a roof portion having open end surfaces to permit portion of the inclined surfaces of the blade-like member to extend therethrough. The sheath member has a length slightly less than the blade-like member such that some compression of the front end thereof is required to bring the same into registration with the sheath member. The sheath member is of sufficient width so that an envelope may be wrapped around the blade-like member, and the blade-like member and the envelope may be pressed into the sheath member. The sheath member may be configured with outer ribs to enhance its structural integrity. The sheath member is provided with a flange about the periphery of its base which cooperates with the front open end surfaces to define an apertured latching member which cooperates with a notch in the front surface of the blade-like member to lock the blade-like member in registration with the sheath member. Hubbard et al. does not disclose a hinge safety lock feature.

U.S. Pat. No. 5,050,272, issued Sep. 24, 1991 to Steven R. Robinson et al., discloses a closure member including a longitudinal sheath and blade that snaps into the sheath. The sheath and blade each include parallel side walls and a base perpendicular to the side walls. The side walls of the sheath are spaced apart to define a slot therebetween. The side walls of the blade have parallel, outwardly protruding ribs which frictionally engage the interior surface of the side walls of the sheath. The sheath and blade also have a pivot end and a locking end. A pin extends between the sides walls at the pivot end of the sheath and a hook for receiving the pin is located at the pivot end of the blade. The locking end of the sheath includes a partition having a locking shoulder and a retaining wall forward of the partition defining a slot therebetween and the locking end of the blade has a locking member extending therefrom. The locking member has a tip with a locking shoulder positioned to frictionally engage the partition locking shoulder when the closure is in a locked position. Robinson et al. does not disclose a hinge safety lock feature.

U.S. Pat. No. 5,125,133, issued Jun. 30, 1992 to William Morrison, discloses a one-piece plastic clamp including a thin, elongated, planar wedge member and a narrow, channel-defining trough. The trough includes side walls that are spaced apart to define a channel therebetween. The trough is generally U-shaped in cross-section having an open top, a closed bottom, and a pair of opposite ends. The hinged member has a thin, elongated body with generally parallel, longitudinal, upper and lower edges, and opposite ends. A hinged end of the trough is joined to a hinged end of the blade by a thin, narrow, flexible strap integrally formed with the trough and the blade so as to produce a clamp of unitary construction. Though the clamp is formed of a rigid plastic material, the strap is flexible and deformable because of its thin, narrow dimension. As a result, a possible disadvantage exists in that the wedge may easily twisted out of alignment with the trough. It is suggested that the wedge and the trough may be separable, thus providing a clamp that is not of unitary construction. The trough is provided with a slit-like opening that cooperates with an integral latch element at the end of the body of the wedge member. The latch element tapers forwardly of the lower edge of the body and includes a shoulder that engages a lip that extends across the closing of the slit-like opening. When the clamp is closed, the latch element flexes inwardly about its point of connection and as soon as it clears the lip, it springs back to an original position to hold the members in a latched condition. An enlargement at the free end of the latch element serves as a lever for urging the latch element into an unlatched position when it is desirable to open the clamp. A thin, integral guide blade extends in an endwise direction from the hinged end of the wedge member. The guide blade extension has a smoothly-curved outline that merges smoothly with the lower edge of the trough. The guide blade is spaced well below the point of attachment between the hinge and the body of the wedge and, when the clamp is closed, the guide blade extends into and through a slit-like opening in the hinged end of the trough. The hinged end wall of the trough has a rounded lower edge surface which serves as a bearing surface for camming the wedge member downward when it engages the curved edge of the guide blade seating the wedge in the trough. Even if the hinge strap should become damaged and broken in use, the blade guide will ensure that the clamp remains in a closed condition until such time that it is intentionally released and the wedge member is pivoted into its raised position. Morrison points out a disadvantage is his invention being in that the thin, narrow, flexible strap enables the blade to twist out of alignment with the trough. Applicants overcome this disadvantage by employing a substantially wide strap. Though Morrison incorporates a guide blade, Morrison's guide blade includes a guide blade extension integral with the blade and engageable with a lower edge extending along an opening in the hinged end of the sheath, wherein applicants guide blade includes a smoothly-curved recess in the blade for receiving a curved shoulder in the trough. The guide blade disclosed by Morrison is located in a plane beneath the hinge strap and the guide blade included in applicants' invention is located a plane above the hinge strap.

A bag closure comprising a trough joined to a blade by a living hinge that is dimensioned and configured so as to resist breaking and ensure that the trough and the blade remain in alignment is desirable. Moreover, the closure in general should be dimensioned and configured such that the same may carry indicia in the form of operational instructions and a logo. The implementation of a safety lock to ensure that the closure remain closed in the event that the hinge becomes damaged or broken would place such a closure in greater demand. In addition, the safety lock should ensure the proper alignment of the trough and the blade as well as relieve stress otherwise normally sustained by the hinge. This safety lock would preferably be contained within the member, i.e. within the trough, where it would remain concealed and unobtrusive during the use of the closure. The locking portion of the bag closure should include a latch element having a portion thereof which permits the same to be easily unlatched and, in turn, enables the closure to be opened effortlessly. These and other features would overcome some of the obvious disadvantages noted in well known closures.

It should be noted that none of the above patents, taken either singly or in combination, is seen to describe the instant invention as claimed.

SUMMARY OF THE INVENTION

The present invention relates to a bag closure for closing and sealing bags, such as ice packs and the like. The closure comprises a sheath and a wedge-shaped member. The sheath includes spaced apart side walls and a roof forming a trough having a substantially U-shaped cross-section. The roof is preferably dimensioned to permit indicia, such as operating instructions and/or a logo, to be displayed thereon. The wedge-shaped member includes spaced apart side walls an upper edge forming a blade or blade-like body. The upper edge is provided with raised sections disposed at opposite ends thereof and a lower intermediate section therebetween wherein a bag, such as an ice pack, is received. The blade-like body has a cross-section slightly smaller than the cross-section of the trough enabling the closure to clamp the bag tightly therein.

A hinge in the form of a strap pivotally connects the sheath to the wedge-shaped member. The hinge strap has a width substantially equivalent to the sheath and significantly greater than that of the blade-like body. This provides a durable hinge, resistant against damage and breakage. The hinge strap will also ensure that the blade-like body remains in proper alignment with the trough.

A wedge-shaped member includes a latch or latch element that cooperatively engages an opening in the sheath. The latch element has an upper tip, a cam surface and a shoulder. The opening is bounded along one side by a shoulder of the locking end of the sheath. The lip is located atop the locking end and adjacent the opening. Upon closing the closure, the cam surface of the latch element engages an interior surface of the locking end of the sheath flexing the latch element rearward until shoulder extends beyond the lip where the latch element returns forward to abut the shoulder with the lip retain the closure in the closed position. In the closed position, the tip of the latch element protrudes significantly upward through the opening in the sheath forming a protuberance. The protuberance enables the tip to be easily displaced, flexing the latch element rearward and in turn, moving the shoulder out of abutment with the lip to enable the closure to be opened.

A safety lock further ensures that the blade-like body properly aligns with the trough as well as relieves the stress which would otherwise be sustained by the hinge strap. The safety lock also ensures that the closure does not inadvertently come open in the event that the hinge strap becomes damaged and broken. The safety lock includes a blade guide having a convex cam shoulder formed within the trough proximate the hinged end of the sheath and a concave cam surface formed in a lower portion of the blade-like body proximate the hinged end of the wedge-shaped member. The blade guide is concealed within the trough when the closure is in a closed position where it remains unobtrusive during its use. The configuration of the cam shoulder complements that of the cam surface. This is significant in that, upon closing the closure, the cam shoulder engages the cam surface guiding the blade-like body into proper alignment with the trough and relieving stress from the hinge strap. Further, with the closure closed and latch element latched, the cam shoulder abuts the cam surface ensuring that the closure remains closed until the latch element is released.

In use, the neck of a bag is folded about the lower intermediate section of the upper edge of the blade-like body, that is to say, between the two raised sections. Upon closing the closure, the neck of the bag becomes tightly clamped within the trough between the blade-like body and the trough, sealing the bag against leakage.

Accordingly, it is a principal object of the invention to provide a closure for closing and sealing bags wherein the closure comprises a sheath having a trough and a wedge-shaped member having a blade-like body which fits tightly within the trough and wherein the blade-like body has a cross-section slightly smaller than the cross-section of the trough enabling the closure to clamp the bag tightly therein.

Another object is to provide a trough having roof dimensioned so as to permit indicia to be displayed thereon.

A further object is that the wedge-shaped member have a designated location for the proper placement of a bag thereon.

Yet another object is to provide a hinge strap for pivotally connecting the sheath to the wedge-shaped member, the hinge strap having a width substantially equivalent to the sheath yet significantly greater than that of the blade-like body so as to provide a durable hinge, resistant against damage and breakage, as well as a hinge strap which further ensures that the blade-like body remains in proper alignment with the trough.

Still another object is to incorporate a latch element for latching the closure in a closed position wherein, upon closing the closure in the closed position, a significant portion of the latch element protrudes from the closure forming a protuberance which may be easily displaced to permit the closure to be opened.

Another object is to provide a safety lock for ensuring that the blade-like body properly aligns with the trough, for relieving stress which would otherwise be sustained by the hinge strap, and for ensuring that the closure remains closed in the event that the hinge strap fails.

Yet another object is to provide a safety lock which is concealed within the trough when the closure is in a closed position where it remains unobtrusive during its use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
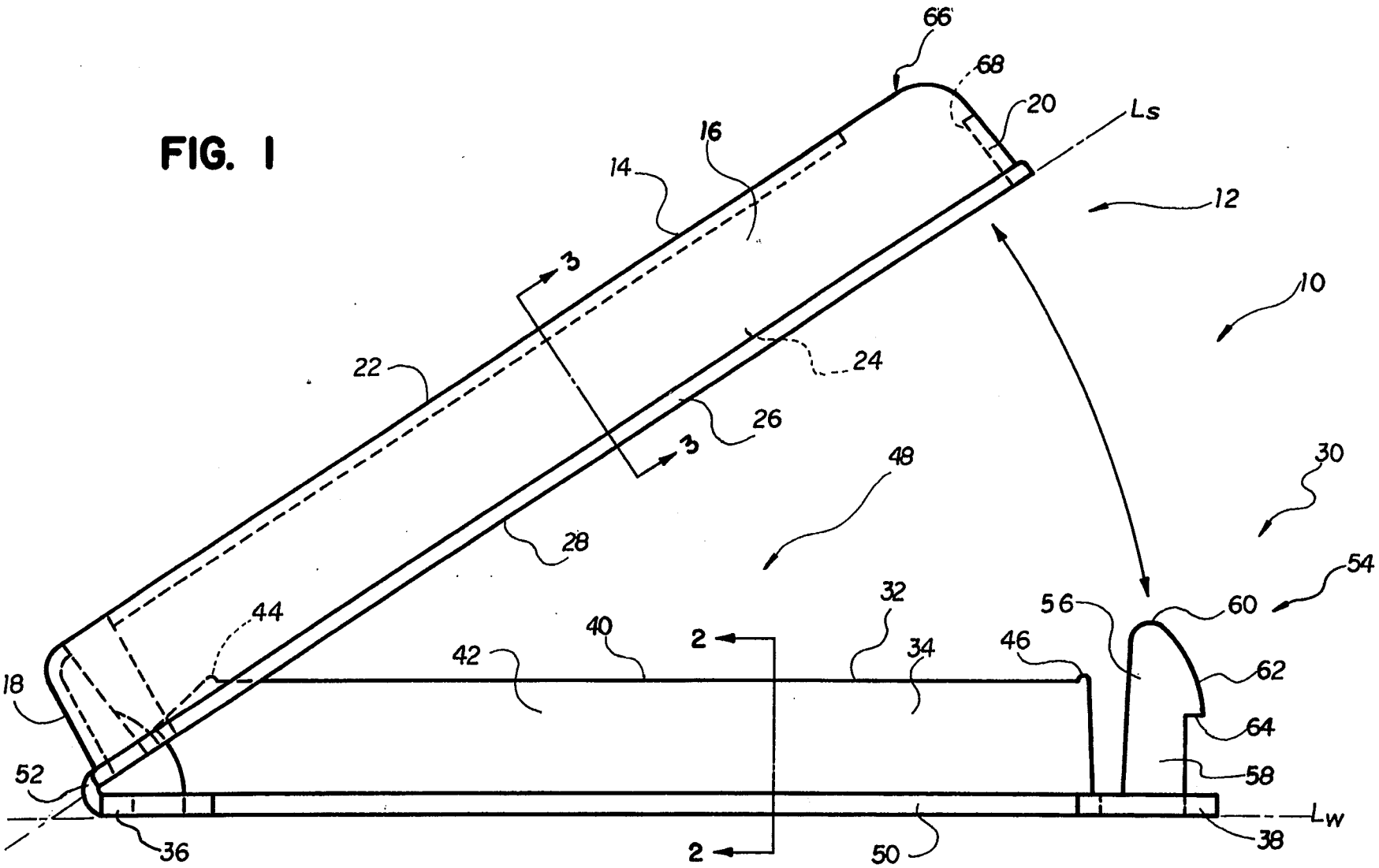
FIG. 1 is a side elevational view of a closure according to the present invention in an open position.
Figure 3:
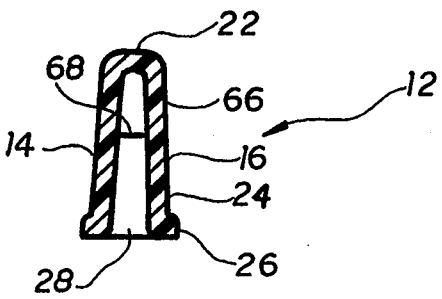
FIG. 3 is a cross-sectional view of the sheath taken along the lines 3—3 in FIG. 1.

Now referring to FIG. 1, a closure 10 is shown. The closure 10 comprises a first component and a second component. The first component is defined by an elongate shaped sheath 12. The sheath 12 includes substantially planar, spaced apart, longitudinally disposed side walls 14, 16 defining an intermediate portion of the sheath 12. Opposite ends 18, 20 of the sheath 12 include a first end 18 being defined as the pivot end of the sheath 12 and a second end 20 being defined as the locking end of the sheath 12. The first and second ends 18, 20 are disposed perpendicularly to the longitudinal axis $L_s$ of the sheath 12. A roof portion 22 extends laterally between the sides walls 14, 16 and longitudinally from the first end 18 to the second end 20. The side walls 14, 16 and the roof portion 22 form a trough 24 having a substantially U-shaped cross-section, as is shown in FIG. 3. A longitudinally disposed base 26 extends perpendicularly to the side walls 14, 16 and includes an elongated opening 28, shown in cross-section in FIG. 3, passing therethrough providing access to the trough 24.

Figure 2:
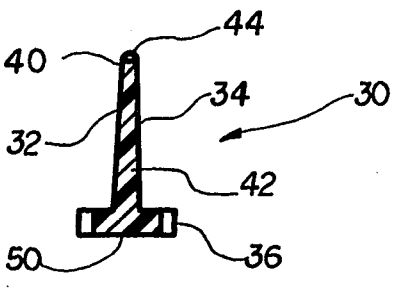
FIG. 2 is a cross-sectional view of the wedge-shaped member taken along the lines 2—2 in FIG. 1.

The second component is defined by an elongate wedge-shaped member 30. The wedge-shaped member 30 includes substantially planar, spaced apart, longitudinally disposed side walls 32, 34 and opposite ends 36, 38. The opposite ends 36, 38 include a first end 36 being defined as the pivot end of the wedge-shaped member 30 and a second end 38 being defined as the locking end of the wedge-shaped member 30. The first and second ends 36, 38 of the wedge-shaped member 30 are disposed perpendicularly to the longitudinal axis $L_w$ of the wedge-shaped member 30. An upper edge 40 extends laterally between the side walls 32, 34 of the wedge-shaped member 30 and longitudinally between the opposite ends 36, 38 of the wedge-shaped member 30. The side walls 32, 34 and the upper edge 40 of the wedge-shaped member 30 form a blade or a blade-like body 42 which is substantially thin and planar. The upper edge 40 has first and second raised sections 44, 46 respectively disposed proximate the first and second ends 36, 38 of the wedge-shaped member 30. These raised sections 44, 46 bound a lower intermediate section 48. The intermediate section 48 provides a designated location for receiving a bag, such as the ice pack P shown in FIG. 7. The blade-like body 42 has a cross-section, as shown in FIG. 2, which is slightly smaller than the cross-section of the trough 24. The difference in the cross-section of the trough 24 and the blade-like body 42 enables the closure 10 to close the ice pack P tightly therein. A longitudinally disposed base 50 extends perpendicularly to the side walls 32, 34 of the wedge-shaped member 30.

As shown in FIGS. 1 and 4–7, a hinge in the form of an integral, flexible hinge strap 52 pivotally connects the pivot end 18 of the first component 12 to the pivot end 36 of the second component 30. The hinge strap 52 has a width substantially equivalent to the width of the base 26 of the sheath 12 and significantly greater than the width of the base 50 of the wedge-shaped member 30 so as to ensure that the blade-like body 42 does not twist out of alignment with the trough 24.

Figure 4:
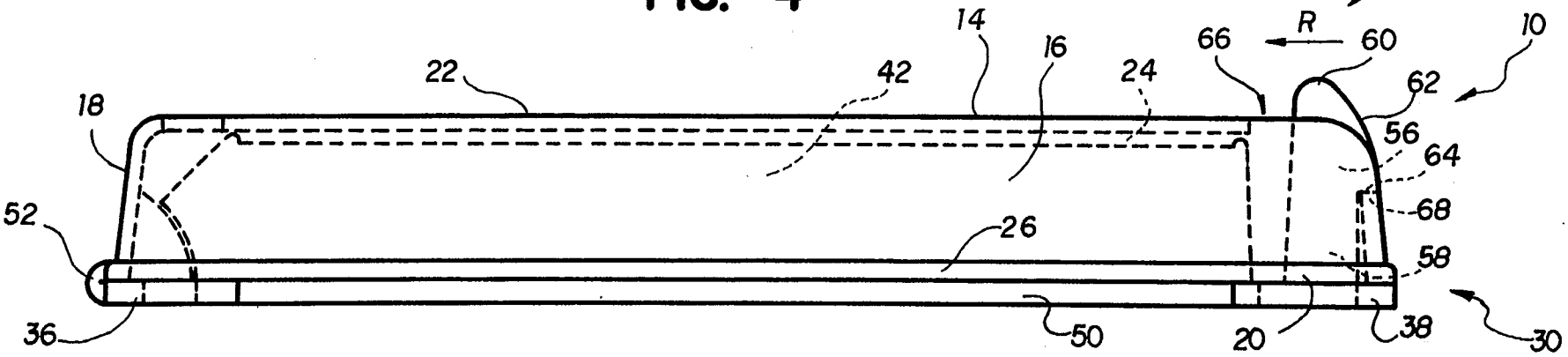
FIG. 4 is a side elevational view of the closure in a closed position.
Figure 5:
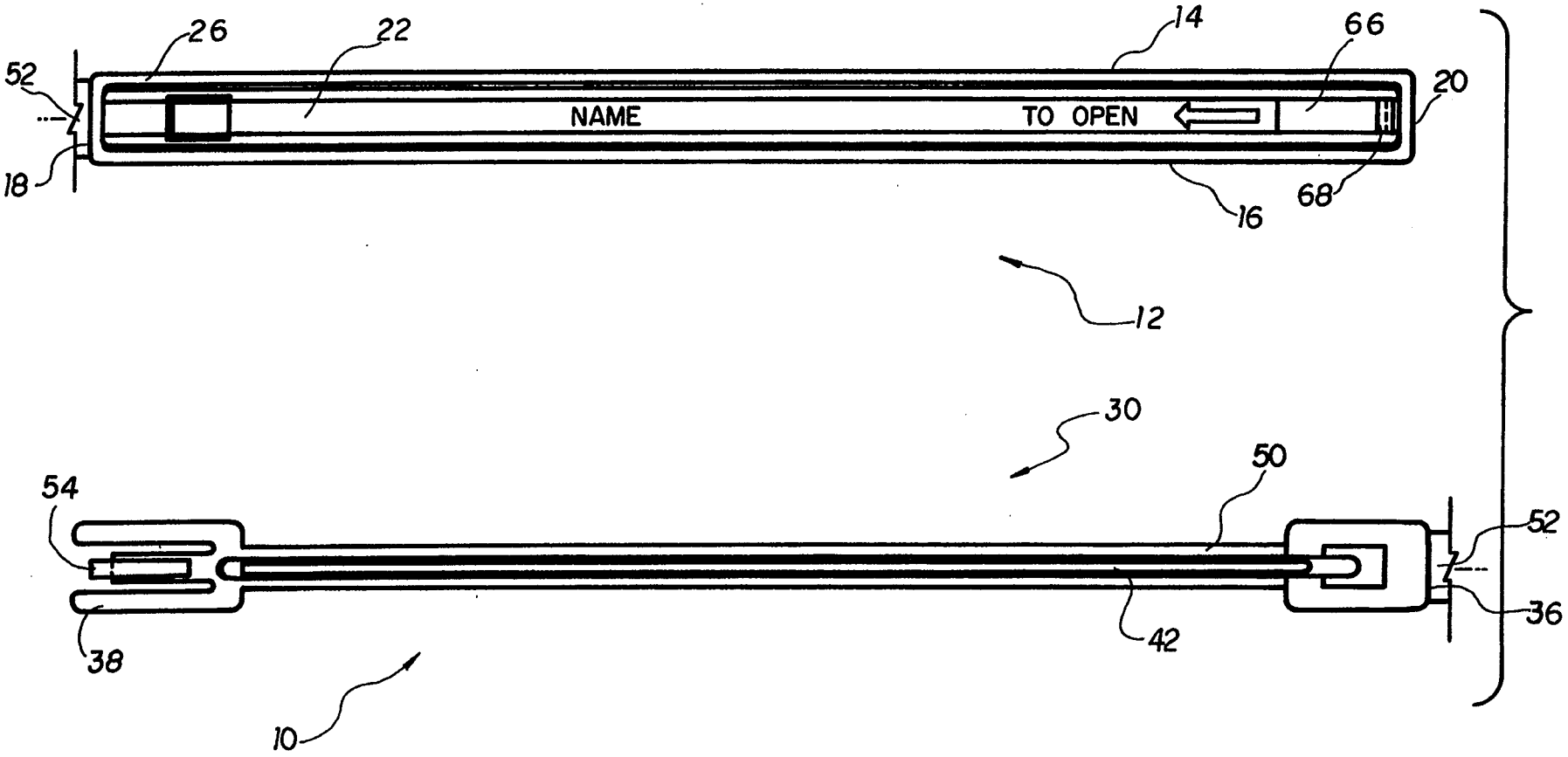
FIG. 5 is a plan view of the closure shown in an open posture.
Figure 6:
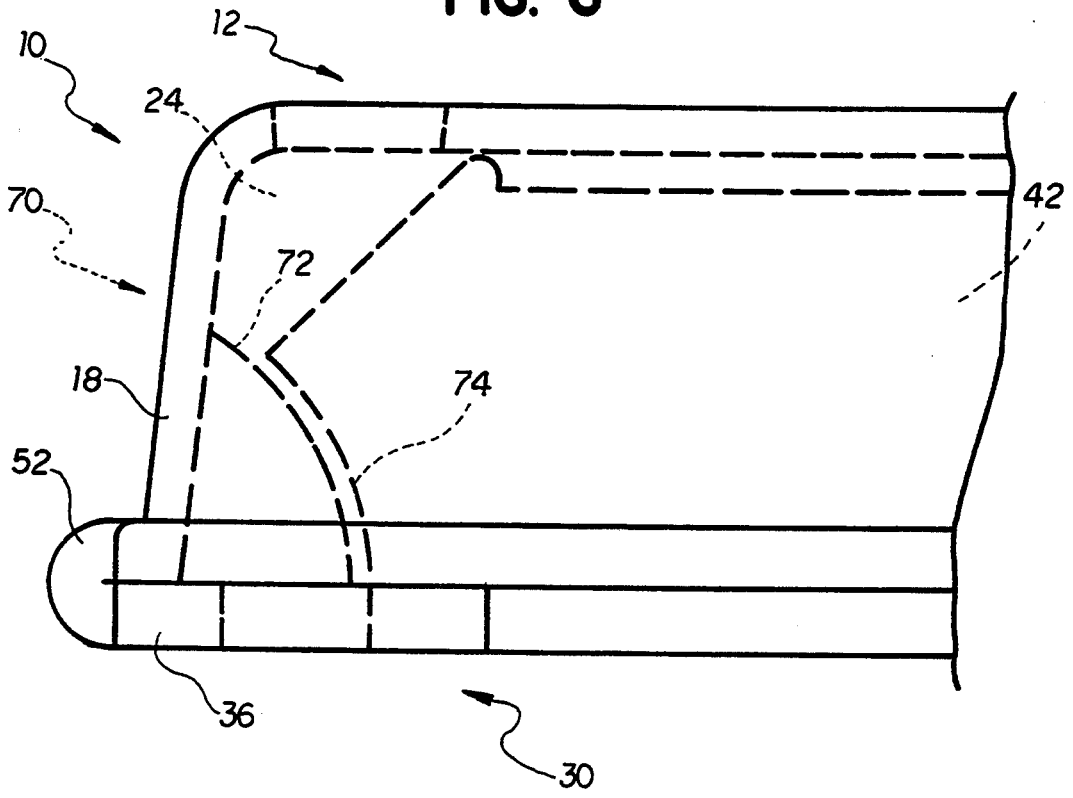
FIG. 6 is an enlarged side elevational view of the safety lock.

Referring back to FIG. 1, the first and second components 12, 30 diverge to opened the closure 10 in an open position in which the closure 10 assumes a V shape with the hinge strap 52 being located at the apex of the V. As shown in FIG. 4, the first and second components 12, 30 converge upon one another to close the closure 10 in a closed position, matingly engaging the trough 24 and the blade-like body 42.

Now, referring to FIGS. 1 and 4, a locking portion is shown. The locking portion includes a latch in the form of a flexible latch element 54, and a longitudinal slit-like opening 66. The latch element 54 is defined by a hook 56 and an integral stem 58. The stem 58 is integral with the wedge-shaped member 30 proximate the locking end 38 of the wedge-shaped member 30 and is disposed perpendicularly to the base 50 of the wedge-shaped member 30. The hook 56 has an upper tip 60, an intermediate, forwardly disposed cam surface 62, and a lower, forwardly disposed shoulder 64. The slit-like opening 66 proximate the locking end 20 of the sheath 12 is bounded by the roof portion 22, the side walls 14, 16, and the second end 20 of the sheath 12. A lip 68 is located atop the second end 20 of the sheath 12 adjacent the slit-like opening 66.

Upon closing the closure 10, the cam surface 62 of the latch element 54 engages the locking end 20 of the sheath 12, flexing the latch element 54 rearward until the hook 56 extends beyond the lip 68 where the latch element 54 flexes forward to abut the shoulder 64 with the lip 68 to retain the closure 10 in the closed position. In the closed position, the tip 60 of the latch element 54 protrudes upwardly through the slit-like opening 66 forming a protuberance, as is shown in FIG. 4.

Upon a reward displacement of the tip 60 of the latch element 54 protruding through the slit-like opening 66, the latch element 54 is flexed rearward in the direction R moving the shoulder 64 out of abutment with the lip 68 enabling the closure 10 to be opened from the closed position to the opened position.

A safety lock 70 ensures that the blade-like body 42 aligns with the trough 24, ensures that the closure 10 does not inadvertently come open in the event that the hinge strap 52 becomes damaged and broken, and relieves stress which would otherwise be sustained by the hinge strap 52. As shown most clearly in FIG. 6, the safety lock 70 includes a blade guide having a forwardly extending, smoothly-curved, convex cam shoulder 72 formed within a lower portion of the trough 24 proximate the pivot end 18 of the sheath 12. The safety lock 70 further includes a forwardly extending, smoothly-curved, concave cam surface 74 formed in a lower portion of the blade-like body 42 proximate the pivot end 36 of the wedge-shaped member 30. The cam shoulder 72 within the sheath 12 is formed into a shape which complements the shape of the cam surface 74 of the blade-like body 42. In operation, upon closing the closure 10, the cam shoulder 72 cammingly engages the cam surface 74 guiding the blade-like body 42 into alignment with the trough 24 and relieving stress from the hinge strap 52. When the closure 10 is closed and latch element 54 is latched, the cam shoulder 72 abuts the cam surface 74. If the hinge strap 52 were to break, the abutting cam shoulder 72 and cam surface 74 would maintain the closure 10 and a closed position.

Figure 7:
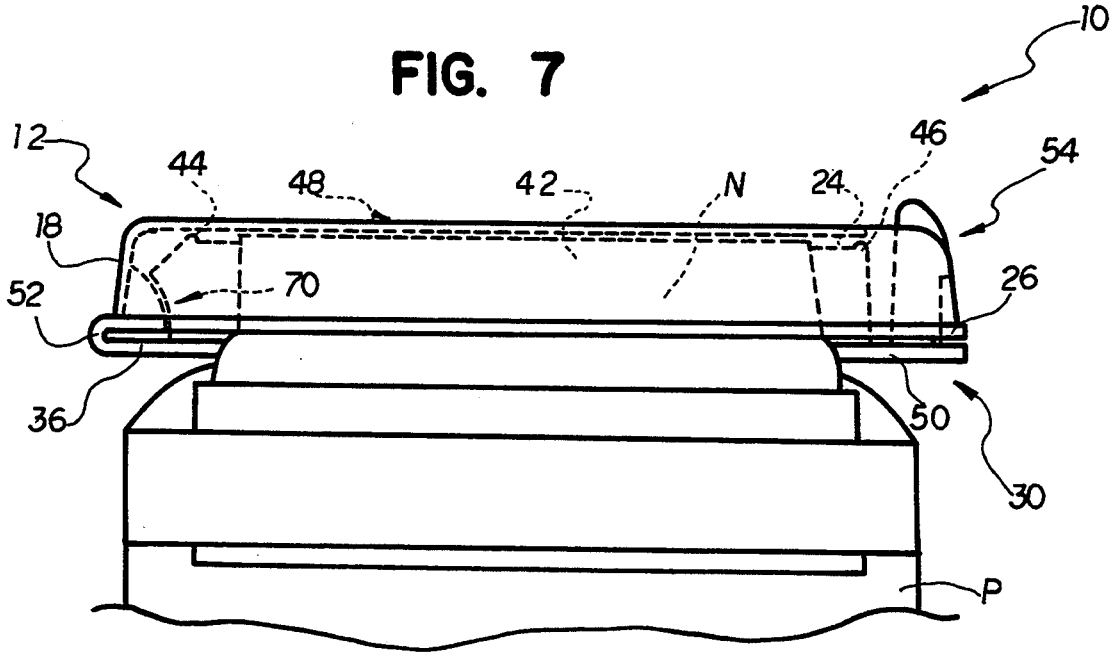
FIG. 7 is an environmental side elevational view of the closure attached to an ice pack.

In use, the neck N of an ice pack P is folded about the lower intermediate section 48 of the upper edge 40 of the blade-like body 42 between the two raised sections 44, 46. Upon closing the closure 10, as shown in FIG. 7, the neck N of the ice pack p becomes clamped tightly within the trough 24 between the blade-like body 42 and the trough 24, sealing the ice pack P against leakage. In the event that the hinge strap 52 becomes damaged and broken, the safety lock 70 ensures that the closure 10 remains in a closed position until such time that the latch element 54 is intentionally released.

It is also to be understood that the present invention is not limited to the embodiment described above, but encompasses any and all embodiments within the scope of the following claims.

We claim:

1. A closure comprising:

a trough;

a blade engageable with said trough, whereby a bag may be sealed therebetween;

a hinge pivotally connecting said trough to said blade;

a latch for releaseably maintaining said closure in a closed position;

a smoothly-curved, protruding cam shoulder formed within said trough proximate to said hinge;

a complementary, smoothly-curved cam surface formed in said blade proximate said hinge, said complementary, smoothly-curved cam surface contoured to complement said smoothly-curved cam shoulder, whereby upon closing said closure, said smoothly-curved cam shoulder engages said complementary, smoothly-curved cam surface.

2. The closure according to claim 1, wherein said cam shoulder has a convex surface protruding within said trough, and said cam surface is concave and complementary to said convex surface of said cam shoulder.

3. A closure comprising:

a) a first component being defined by an elongate sheath, said sheath including:

1) substantially planar, spaced apart, longitudinally disposed side walls defining an intermediate portion of said sheath, 2) opposite ends including:

a) a first end being defined as a pivot end of said sheath and being disposed perpendicularly to a longitudinal axis of said sheath, and b) a second end being defined as a locking end of said sheath and being disposed perpendicularly to said longitudinal axis of said sheath, 3) a roof portion extending laterally between said side walls and longitudinally from said first end to said second end, said side walls and said roof portion defining a trough having a substantially U-shaped cross-section, and 4) a longitudinally disposed base extending perpendicularly to said side walls, said base including means defining an elongated opening passing therethrough providing access to said trough;

b) a second component being defined by an elongate wedge-shaped member, said wedge-shaped member including:

1) substantially planar, spaced apart, longitudinally disposed side walls, 2) opposite ends including:

a) a first end being defined as a pivot end of said wedge-shaped member and being disposed perpendicularly to a longitudinal axis of said wedge-shaped member, and b) a second end being defined as a locking end of said wedge-shaped member and being disposed perpendicularly to said longitudinal axis of said wedge-shaped member, 3) an upper edge extending laterally between said side walls of said wedge-shaped member and longitudinally between said opposite ends of said wedge-shaped member, said side walls and said upper edge of said wedge-shaped member defining a blade-like body being substantially thin and planar, said upper edge having first and second raised sections respectively disposed proximate said first and second ends of said wedge-shaped member bounding a lower intermediate section, said blade-like body having a cross-section smaller than said cross-section of said trough, whereby said intermediate section provides a location for placement of a bag to which said closure is to be applied and said difference in said cross-section of said trough and said blade-like body enables said closure to close the bag tightly therein, and 4) a longitudinally disposed base extending perpendicularly to said side walls of said wedge-shaped member;

c) an integral, flexible hinge strap pivotally connecting said pivot end of said first component to said pivot end of said second component, said hinge strap having a width substantially equivalent to a width of said base of said sheath and significantly greater than a width of said base of said wedge-shaped member so as to reduce a risk of said blade-like body twisting out of alignment with said trough, whereby when said first component is divergent from said second component, said closure is in an opened position assuming a posture having a V-shape with said hinge strap located at an apex of the V-shape, and whereby when said first component is converged upon said second component, said closure is in a closed position matingly engaging said trough and said blade-like body;

d) a locking portion including 1) a flexible latch element being defined by a hook and an integral stem, said stem being integral with said locking end of said wedge-shaped member and being disposed perpendicularly to said base of said wedge-shaped member, said hook having:

a) an upper tip, b) an intermediate cam surface, and c) a lower shoulder, 2) means defining a longitudinal slit-like opening in said locking end of said sheath, said slit-like opening being bounded by said roof portion, said side walls and said second end of said sheath, and 3) a lip integral with said second end of said sheath and adjacent to said slit-like opening, whereby upon closing said closure, said intermediate cam surface engages said locking end of said sheath, and whereby said shoulder engages said lip, thus releaseably retaining said closure in the closed position; and e) a safety lock including:

1) a blade guide having:

a) a protruding, smoothly-curved cam shoulder formed within said trough proximate said pivot end of said sheath, and b) a complementary, smoothly-curved cam surface formed in said blade-like body proximate said pivot end of said wedge-shaped member, said complementary, smoothly-curved cam surface being contoured to complement said smoothly-curved cam shoulder, whereby upon closing said closure, said smoothly-curved cam shoulder engages said complementary, smoothly-curved cam surface.

4. The closure according to claim 3, wherein said roof portion is capable of having intelligible indicia permanently fixed thereupon.

5. The closure according to claim 4, wherein said roof portion has intelligible indicia permanently fixed thereupon.

6. The closure according to claim 5, wherein said indicia is in the form of printed matter.

* * * * *